US007367076B2

(12) United States Patent
Makarov et al.

(10) Patent No.: US 7,367,076 B2
(45) Date of Patent: May 6, 2008

(54) DRY POWDER SPREADER

(76) Inventors: Sergey V. Makarov, 33273 Cottesmore Pl., Solon, OH (US) 44139; Kenneth H. Cooper, 176 Stull Ave., Akron, OH (US) 44312; Mark A. Stransky, 115 Lindsey Rd., Monroe Falls, OH (US) 44262; Donald A. Coates, 5045 Hollyhock Ave., N.W., Canton, OH (US) 44718; Mark T. Smith, 3342 Capricio St., Canton, OH (US) 44721; Adrian M. West, 23 Wedgewood Rd., West Newton, MA (US) 02465; Patrick McDermott, 13 Foster St., Oxford, MA (US) 01540; John A. MacNeill, 33 Ashmont St., Melrose, MA (US) 02176; Jo Frances Wollschlaeger, 47 Park Vale #12, Allston, MA (US) 02134

( * ) Notice: Subject to any disclaimer, the term of this patent is extended or adjusted under 35 U.S.C. 154(b) by 703 days.

(21) Appl. No.: 10/449,223

(22) Filed: May 29, 2003

(65) Prior Publication Data

US 2004/0238004 A1 Dec. 2, 2004

(51) Int. Cl.
*A47L 11/32* (2006.01)

(52) U.S. Cl. ..... 15/41.1; 15/52.1; 222/199; 222/200; 222/216

(58) Field of Classification Search ..... None
See application file for complete search history.

(56) References Cited

U.S. PATENT DOCUMENTS

| | | | | |
|---|---|---|---|---|
| 3,781,937 | A | | 1/1974 | Jacobs |
| 4,097,953 | A | * | 7/1978 | McKinney et al. ..... 15/320 |
| 4,121,733 | A | | 10/1978 | McRoskey et al. |
| 4,183,112 | A | | 1/1980 | Brown et al. |
| 4,240,569 | A | | 12/1980 | Bessinger |
| 4,268,935 | A | | 5/1981 | Bessinger |
| 4,447,930 | A | | 5/1984 | Glenn, III |
| 4,457,042 | A | | 7/1984 | Jones et al. |
| 4,549,328 | A | | 10/1985 | Martin et al. |
| 4,615,068 | A | | 10/1986 | Martin et al. |
| 4,699,537 | A | | 10/1987 | Cook, Jr. |
| 5,077,862 | A | | 1/1992 | Rench |

(Continued)

FOREIGN PATENT DOCUMENTS

| | | |
|---|---|---|
| EP | 182230 | * 11/1985 |

*Primary Examiner*—David A Redding

(57) ABSTRACT

A carpet cleaning machine for uniformly spreading a dry carpet cleaning powder onto a surface and working the dry carpet cleaning powder into the surface. The cleaning machine includes base having a hopper integrally formed therein, distribution slots on the bottom of the hopper, a rotary powder agitator inside the hopper, wheels for supporting the base over a floor surface and for rotating the powder agitator, a metering gate for controlling the dispensing of the dry carpet cleaning powder, a trigger located on the cleaner handle for controlling the metering gate, and a plurality of motor driven vertical axis rotary brushes for working the dry carpet cleaning powder into the carpet. The dry carpet cleaning powder is dispensed onto the carpet and allowed to sit for a short period of time to allow the dry carpet cleaning powder to absorb the dirt contained in the carpet. After the dry carpet cleaning powder has dried and absorbed dirt, the dry carpet cleaning powder and dirt are vacuumed from the carpet with an ordinary vacuum.

18 Claims, 12 Drawing Sheets

U.S. PATENT DOCUMENTS 5,077,863 A 1/1992 Rench
5,086,539 A 2/1992 Rench
5,101,532 A 4/1992 Dyson et al.
5,307,538 A 5/1994 Rench et al.
5,427,283 A * 6/1995 Whittaker et al. ..... 222/414

* cited by examiner

DRY POWDER SPREADER

BACKGROUND OF THE INVENTION

1. Field of the Invention

This invention relates to a floor care appliance, and more particularly, to a carpet cleaning machine for distributing and working into the carpet a dry powder carpet cleaning composition.

2. Summary of the Prior Art

Carpet cleaning machines utilizing a dry powder cleaning composition are known in the art. Typically, these carpet cleaners have a hopper for holding a quantity of a dry powder carpet cleaning composition. The dry powder is distributed onto the carpet to absorb dirt contained in the carpet. Usually, a short period of time is given to allow the dry powder to absorb the dirt before the dry powder is vacuumed up. Some of these known carpet cleaners have a vacuum source and dirt collecting chamber onboard for this purpose.

For example, in U.S. Pat. No. 5,101,532 issued to Dyson et al. provides a method and apparatus for controlling dispensing of "dry" powdered compositions particularly carpet cleaning compositions wherein the confined finely divided particles descend in a stream under gravity and have oscillatory movement imparted thereto next before discharge through an orifice leading therefrom so as to agitate, separate and propel the particles therethrough; and in the case of carpet cleaning operations depositing the finely divided discharged particles onto the surface of the fibres in a substantially uniform pattern thereover followed by working same into the fibres through the application thereto of a rotary brush or beater and thereafter recovering the residues by a suitable suction or vacuum unit utilizing a rotary brush or beater and an associated two stage cyclone separator.

There are other dry powder carpet cleaners that are add-on devices for existing vacuum cleaners. Examples of these types are found in U.S. Pat. Nos. 4,240,569 and 4,268,935 issued to Bessinger. There are others that attach to the accessory hose of a canister type vacuum cleaner. Examples of these types are found in U.S. Pat. No. 4,447,930 issued to Glenn, III et al., U.S. Pat. No. 4,457,042 issued to Jones et al., and U.S. Pat. No. 4,549,328 issued to Martin et al.

Further, there are carpet cleaners designed for use with dry chemical cleaning compositions which do not dispense the dry chemical composition but work the composition into the carpet and later vacuum up the chemical composition and the absorbed dirt. Examples of these types of carpet cleaners are found in U.S. Pat. No. 5,307,538 issued to Rench et al. and U.S. Pat. No. 5,086,539 issued to Rench.

The present invention is distinguished from all of these cleaners, inter alia, because it is designed exclusively to be a dry powder carpet cleaner dispenser with agitators for working the powder into the carpet. It does not have a vacuum source to remove the dry powder and the absorbed dirt. It is designed to be used in conjunction with an ordinary vacuum cleaner which is present in almost every household. This is a benefit to the consumer in terms of saving the extra cost incorporating a vacuum source for particulate removal into the device.

It is an object of the invention to provide a dry powder carpet cleaner having a dispensing system for uniform application of a dry powder carpet cleaning composition on carpet.

It is another object of the invention to provide a dry powder carpet cleaner for working the recently dispensed powder into the carpet.

It is yet another object of the invention to provide a dry powder carpet cleaner with a hopper having a rotary powder mixing agitator contained therein.

It is yet still another object of the invention to provide a dry powder carpet cleaner with a hopper having a rotary powder mixing agitator contained therein driven by the cleaners wheels.

It is another object of the invention to provide a dry powder carpet cleaner with a a plurality of vertical axis rotary agitators for working the dry powder carpet cleaning composition into the carpet.

SUMMARY OF THE INVENTION

The invention is a carpet cleaning machine for uniformly spreading a powder onto a surface and working the powder into the surface. The cleaning machine includes a base having a hopper integrally formed therein, distribution slots on the bottom of the hopper, a rotary powder agitator inside the hopper, wheels for supporting the base over a floor surface and for rotating the powder agitator, a metering gate for controlling the dispensing of the powder, a trigger located on the cleaner handle for controlling the metering gate, and a plurality of motor driven vertical axis rotary brushes for working the powder into the carpet. The powder is dispensed onto the carpet and allowed to sit for a short period of time to allow the powder to absorb the dirt contained in the carpet. After the powder has dried and the dirt absorbed, the powder and dirt are vacuumed from the carpet with an ordinary vacuum.

In an alternate embodiment of the invention, the plurality of vertical axis rotary agitators are replaced by one or more horizontal axis rotary agitators.

In another alternate embodiment of the invention, the hopper is replaced with a bottle on the cleaner handle containing the dry powder carpet cleaning composition. The neck of the bottle is received by an aperture formed in the handle which serves as a conduit which extends to a chamber from which the dry powder is distributed. The conduit may contain a rotary auger to prevent the powder from clumping and to feed the dry powder to the distribution chamber.

In an alternate embodiment of the invention, the dry powder is distributed by a broadcast type spreader. When the release trigger is pulled on the cleaner handle, dry powder is dispensed onto a rotating wheel with radially extending guide vanes. The dry powder is driven in an outward radial direction onto the carpet guided by the guide vanes.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
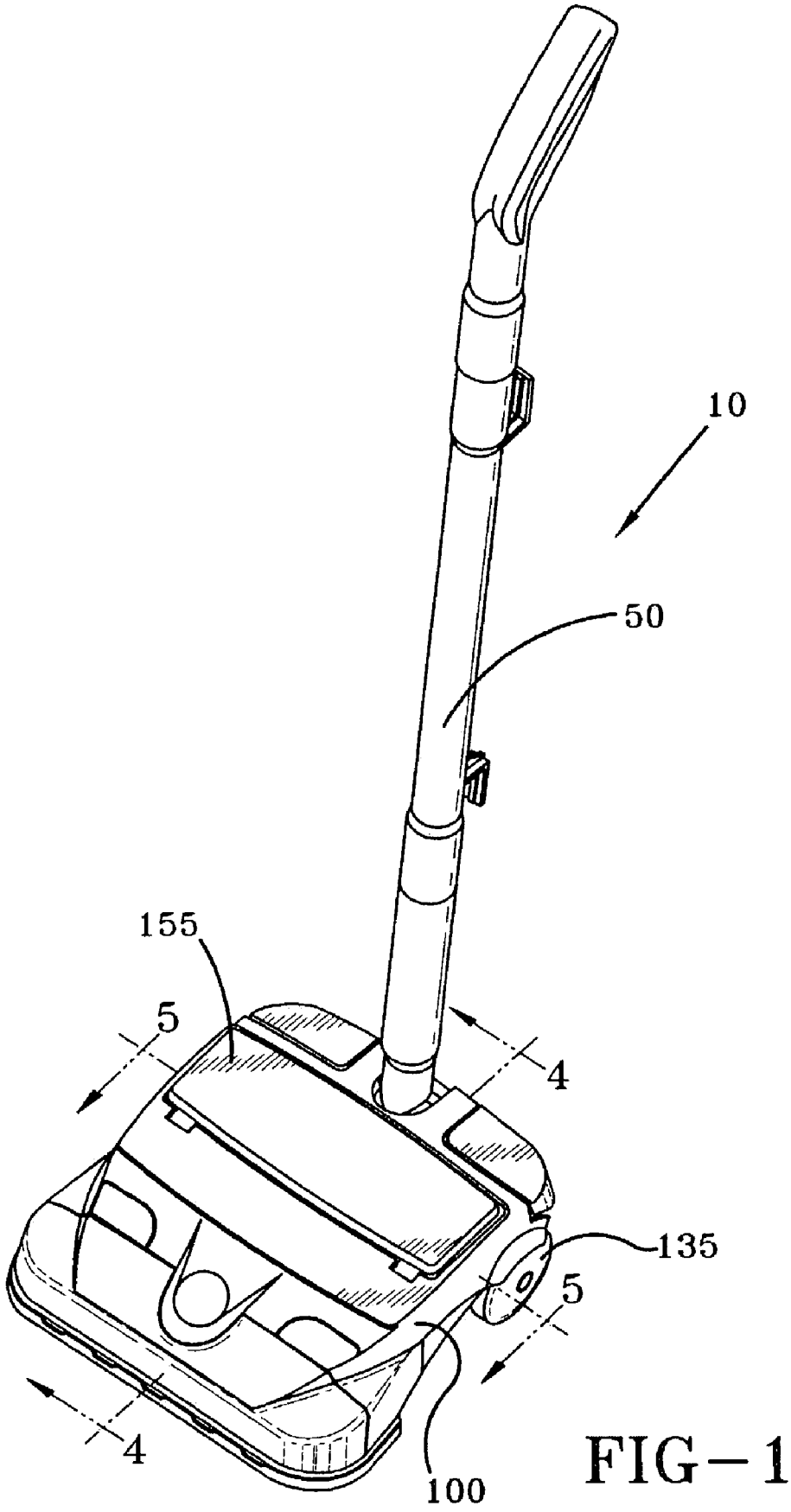
FIG. 1 is a front perspective view of a dry powder carpet cleaner, according to the preferred embodiment of the present invention.

Referring now to FIG. 1, one embodiment of a carpet cleaning machine is shown and is indicated generally as 10. The carpet cleaning machine 10 is for uniformly spreading a dry powder carpet cleaning composition onto carpets and working the dry powder into the surface. In recent years the marketplace has seen several dry powder carpet cleaning compositions which, when properly applied, absorb and lift dirt from the carpet. One such dry powder carpet cleaning composition especially suited for use with the present invention has the tradename RESOLVE™ made by the Reckitt-Benncksiser Corporation. However, there may be other dry powder carpet cleaning compositions that may also be utilized. The suggestion of the suitability of utilizing Resolve™ with the present invention is not meant to be limiting. Carpet cleaning machine 10 includes a handle 50 and a base 100. A trigger 55 located at the upper end of the handle 50 is pulled by the user to selectively distribute the dry powder from a hopper 122 located in the base 100 onto the carpet.

Figure 2:
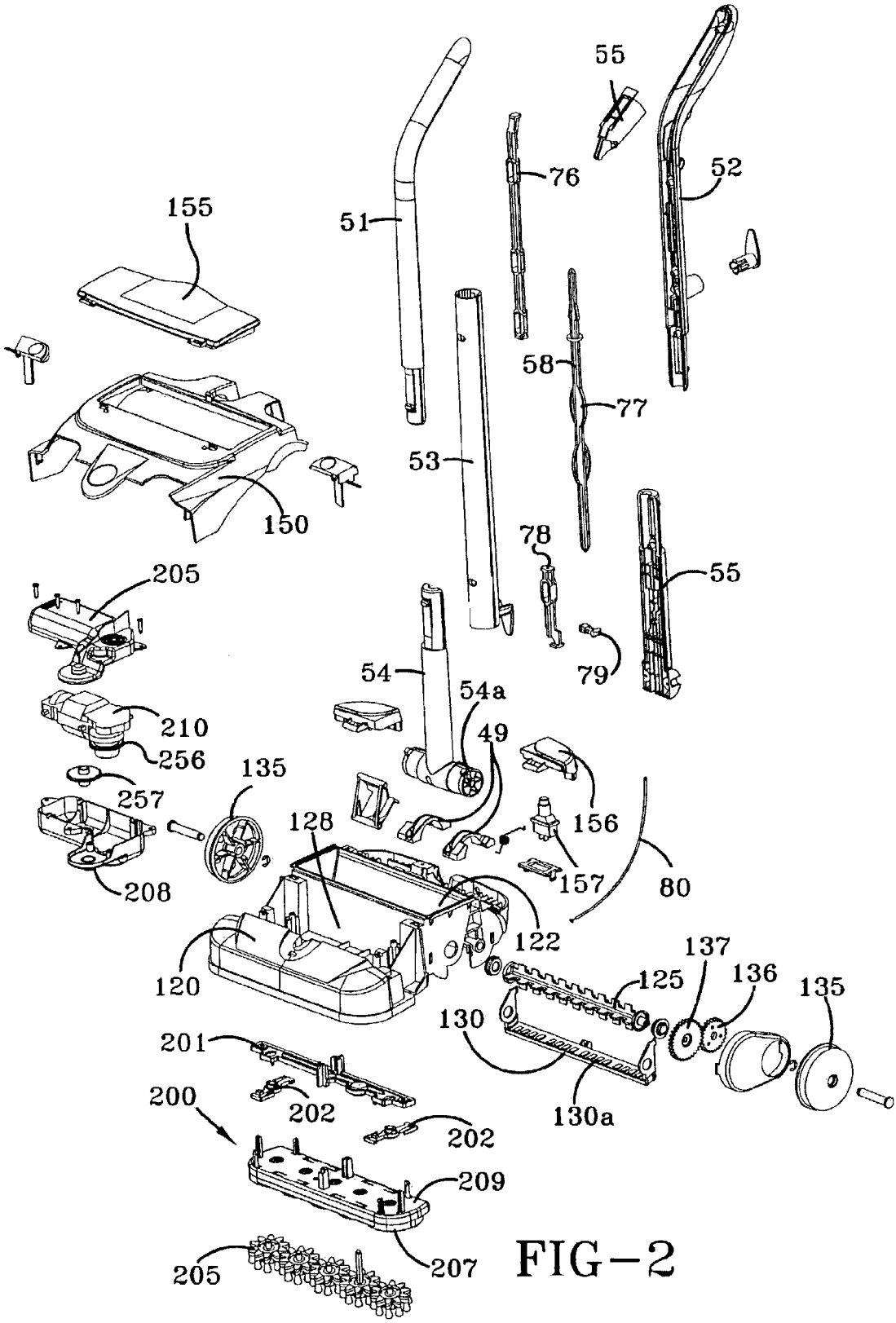
FIG. 2 is a front perspective view of a dry powder carpet cleaner, according to the preferred embodiment of the present invention.

Referring now to FIG. 2, the base 100 of carpet cleaning machine 10 includes a hopper 122 integrally formed therein, a plurality of distribution slots 123 (FIG. 7) on the bottom of the hopper 122 for distributing the dry powder, a rotary powder agitator 125 inside the hopper 122, wheels 135 for supporting the base 100 over the floor surface and for rotating the powder agitator 125, a metering gate 130 for controlling the dispensing of the dry powder, a trigger 55 located on the upper end of the cleaner handle 50 for controlling the metering gate 130, and a plurality of motor driven vertical axis rotary brushes 205 for working the powder into the carpet. The dry powder is dispensed onto the carpet and allowed to sit for a short period of time to allow the dry powder to absorb the dirt contained in the carpet. After the powder has dried and the dirt absorbed, the powder and dirt are vacuumed from the carpet with an ordinary vacuum cleaner. In an alternate embodiment of the invention, the plurality of vertical axis rotary brushes could be replaced with one or more horizontal axis rotary brushes.

The plurality of vertical axis rotary agitators 205 are part of a brush block 200 secured removably secured to the base 100. Brush block 200 is comprised of a brush support plate 207 and an upper plate 209 having a plurality of apertures for receiving a spindle from each of the plurality of brushes 205. The plurality of brushes 205 and the brush block encasing them are similar to the plurality of brushes and brush block in U.S. Pat. No. 6,009,593 issued to Crouser et al., owned by a common assignee, and incorporated by reference fully herein. The plurality of brushes 205 are rotatably driven by an electric drive motor 210 encased in a housing comprised of an upper section 205 and a lower section 208. Motor 210 is controlled by a pedal 156 operated switch 157.

The rotary power of motor 260 is transmitted to one of the plurality of brushes 205 on one end of the brush block 200 by a first gear 256 which engages the motor drive shaft and a second gear 257 which engages one of said plurality of brushes 205. Because of the spur gear design, the driven brush 205 in turn rotates the brush 205 adjacent to it which in turn engages the next adjacent brush. Each brush 205 then rotates each brush 205 adjacent to it in this manner until all of said plurality of brushes 205 are rotated. The brush block 200 is installed in a cavity 203 (FIG. 3) on the underside of main body 120 and is releasably attached therein as described in the '593 patent. Main body 120 has a cavity 128 on the upper side for receiving motor 210 encased in the motor housing comprised of upper section 205 and lower section 208.

The rotary powder agitator 125 is rotated by one or more wheels 135 via a first gear 136 and a second gear 137. Alternately, rotary powder agitator 125 can be rotated by an electric motor. The handle 50 is comprised of an upper section comprised of a first upper handle portion 51 and a second upper handle portion 52. Handle 50 is further comprised of a mid handle portion 53 and a lower portion 54. Handle 50 is pivotally connected to foot 100 by a pair of sidewardly extending trunnions 54*a* secured to main body 120 by a pair of trunnion covers 49. The metering gate 130 is operably connected to trigger 75 via a multi-part rod assembly comprised of an upper rod section 76, mid rod section 77, and a lower rod section 78. The lower rod section engages a lever 79 which is operably connected to a cable 80 which is connected to metering gate 130. The operation and assembly of lower rod section 78, lever 79, and cable 80 is shown in detail in FIGS. 8-10 and described more fully hereinbelow. In alternate embodiments of the invention, the metering gate 130 can be controlled by using a rod assembly only or a cable assembly only connected to trigger 55.

Figure 3:
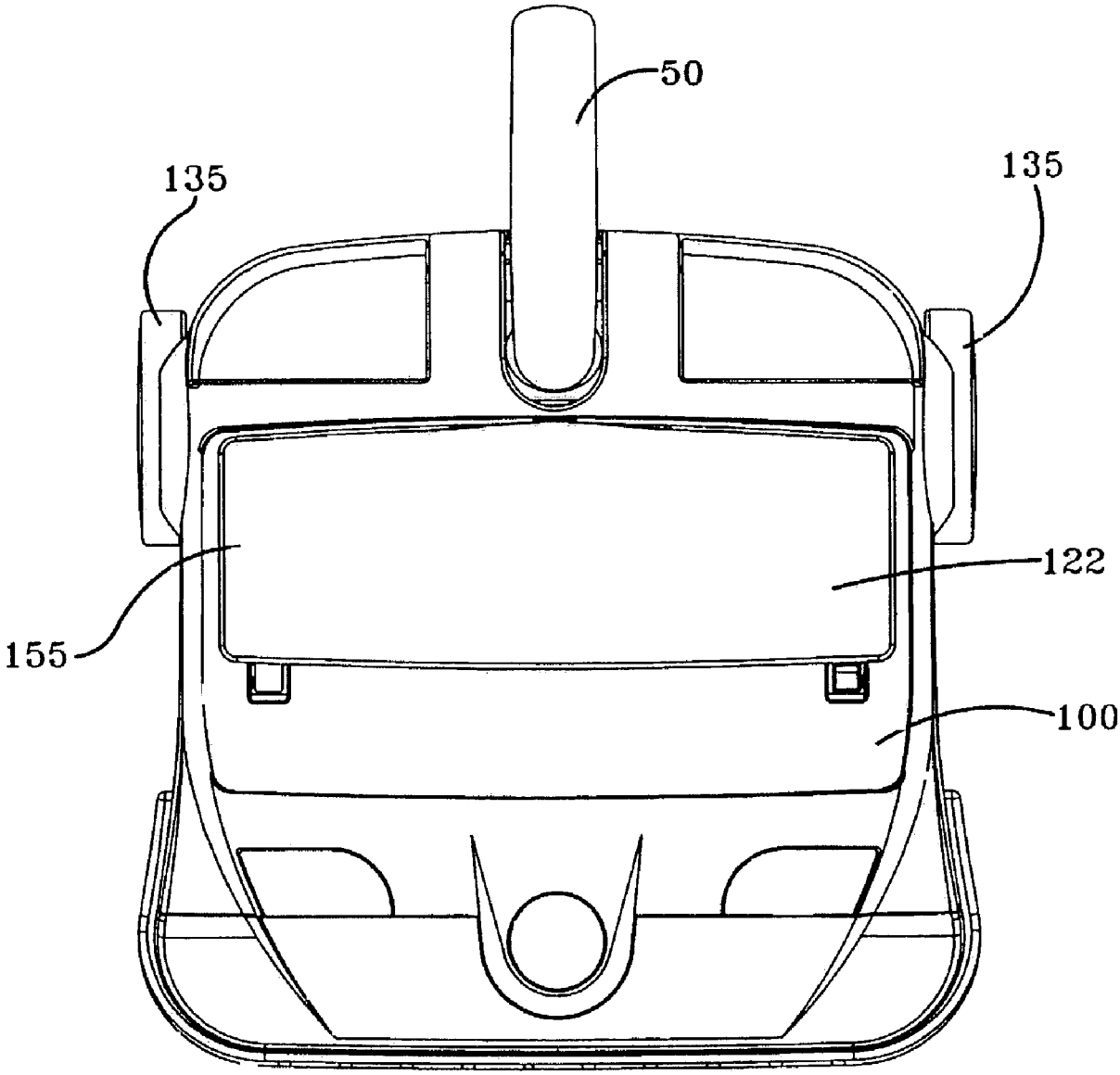
FIG. 3 is top view of the foot of the carpet care cleaner of FIG. 1, according to the preferred embodiment of the present invention.
Figure 4:
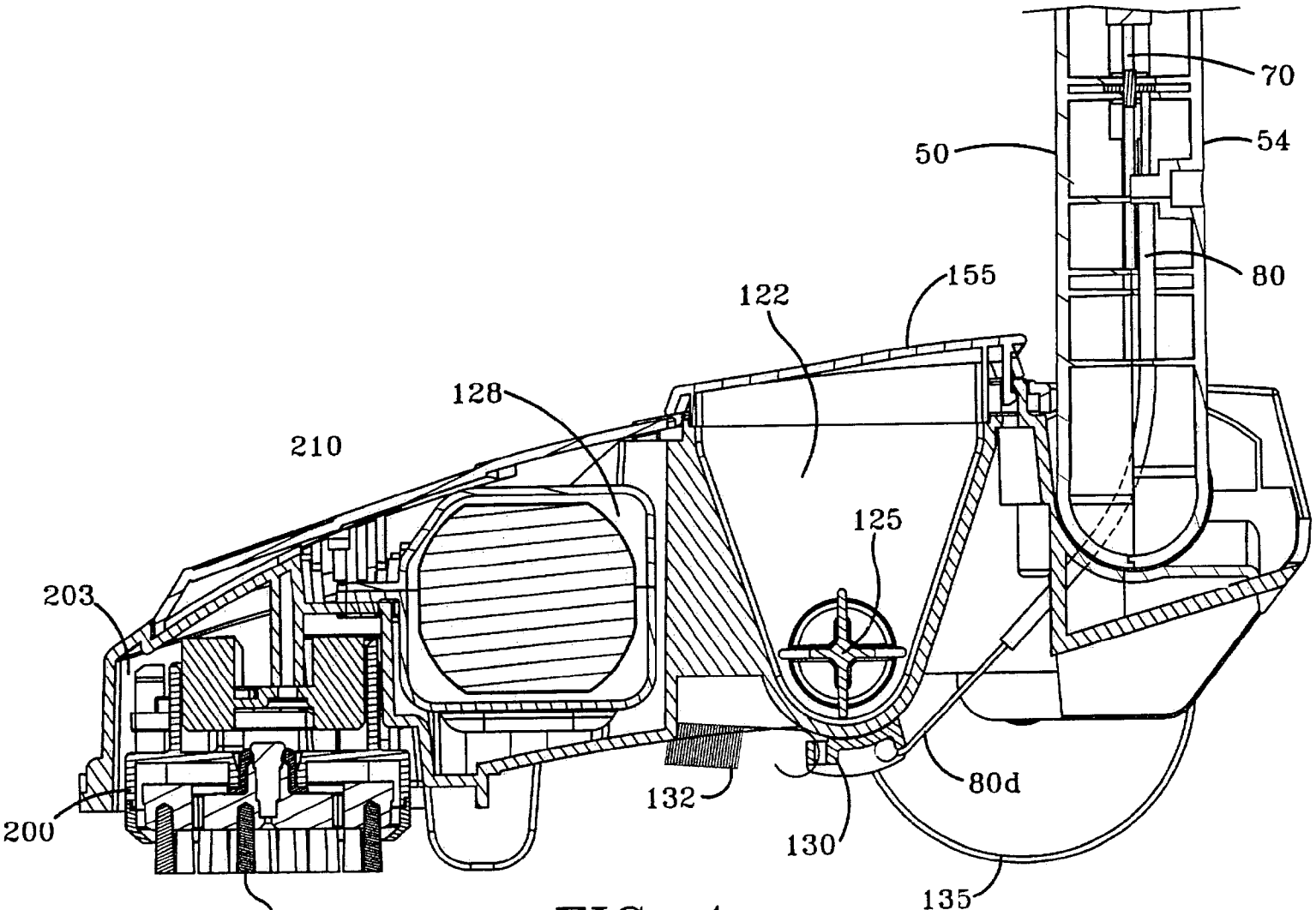
FIG. 4 is a cross-sectional view of the foot of the carpet care cleaner of FIG. 1 taken along line 4-4 in FIG. 1, according to the preferred embodiment of the present invention.

Referring now to FIGS. 3 and 4, a lid 155 is shown covering hopper 122 on foot 100. Rotary powder agitator 125 can be seen in hopper 122. Agitator drive motor 210 is seen in front of hopper 122 located in a cavity 128. Brush block 200 is located in a cavity 203 on the underside of main body 120. The lower end 80*d* of cable 80 is shown operably connected to metering gate 130. The upper end 80*c* (FIGS. 9 and 10) is pivotally connected to lever 79 pivotally attached to the interior of handle 50.

Figure 5:
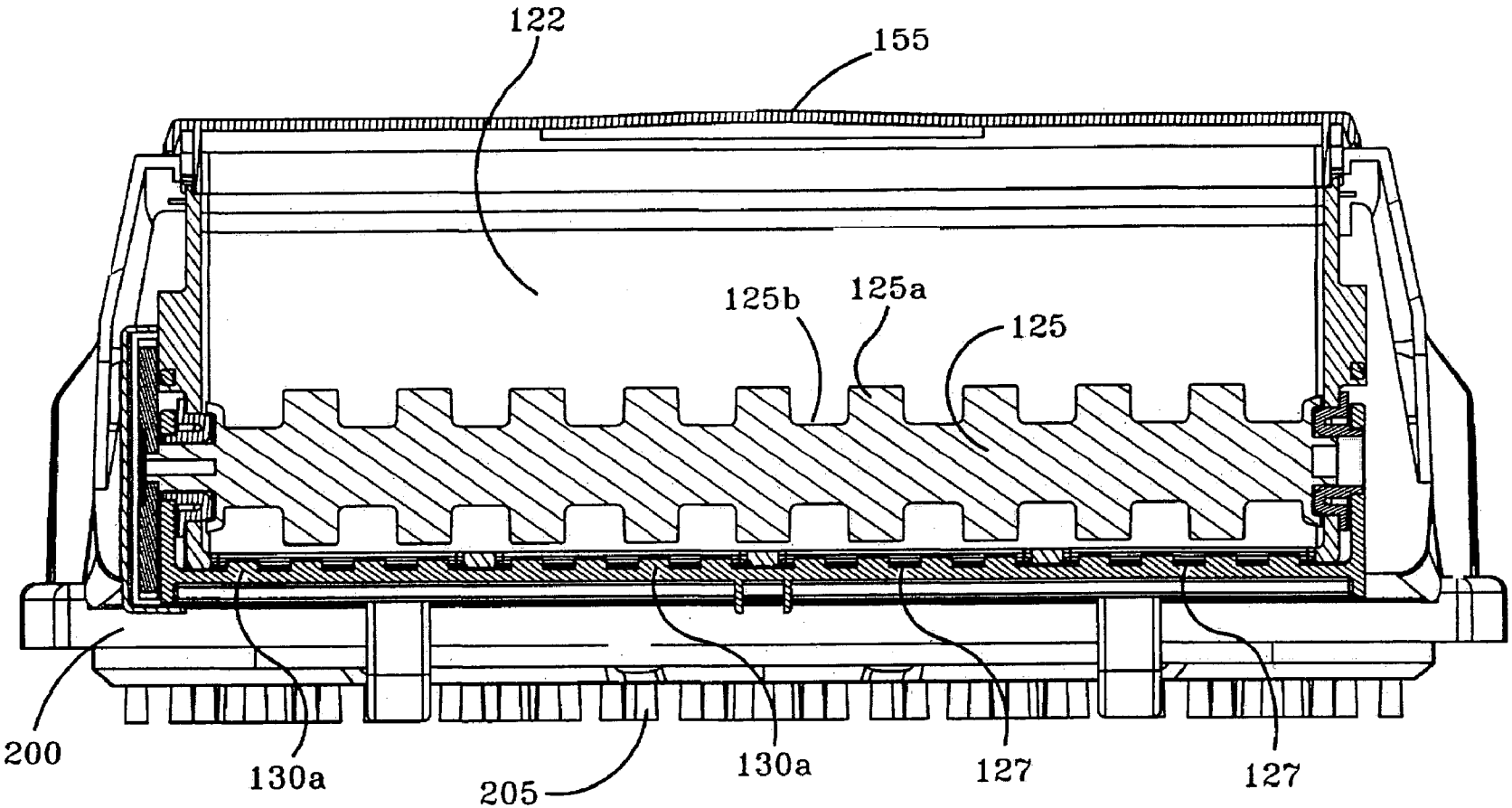
FIG. 5 is a cross-sectional view of the foot of the carpet care cleaner of FIG. 1 taken along line 5-5 in FIG. 1, according to the preferred embodiment of the present invention.
Figure 13:
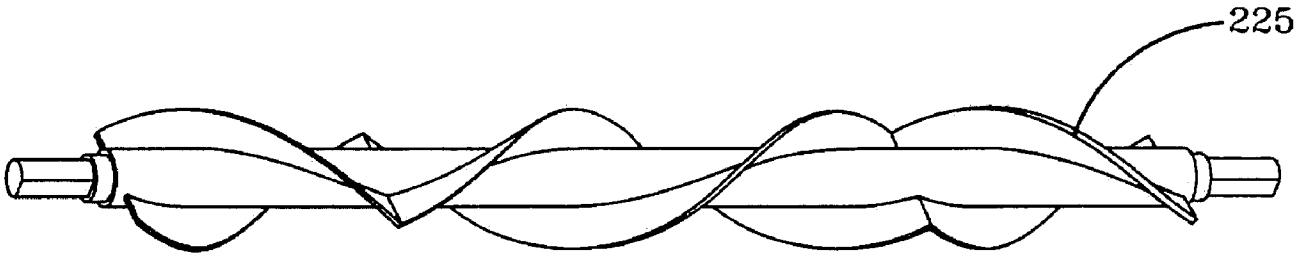
FIG. 13 is a front perspective view of a rotary powder agitator for a dry powder carpet cleaner such as the one shown in FIGS. 1 and 6, according to an alternate embodiment of the present invention.
Figure 14:
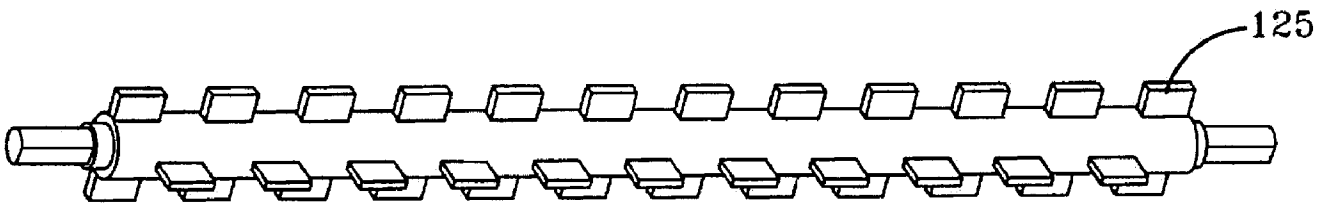
FIG. 14 is a front perspective view of a rotary powder agitator for a dry powder carpet cleaner such as the one shown in FIGS. 1 and 6, according to the preferred embodiment of the present invention.
Figure 15:
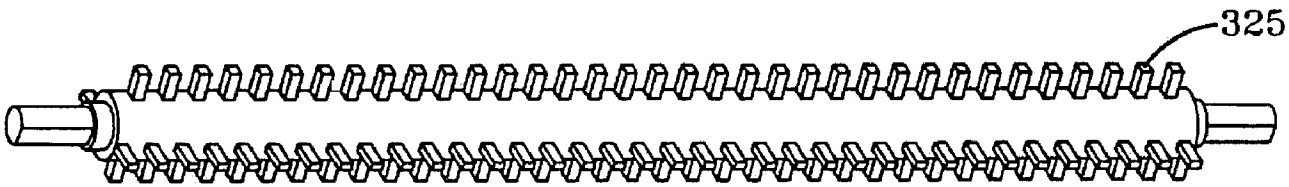
FIG. 15 is a front perspective view of a rotary powder agitator for a dry powder carpet cleaner such as the one shown in FIGS. 1 and 6, according to an alternate embodiment of the present invention.

Referring now to FIG. 5, a cross-section of hopper 122 is shown wherein the details of rotary powder agitator 125 are seen. Rotary powder agitator 125 is comprised of a plurality of radially extending agitator elements 125*a* having a rectangular or other cross-section each separated by a recess 125*b*. Rotary powder agitator 125 is one embodiment of many possible embodiments of a rotary powder agitator including the embodiments shown in FIGS. 13 to 15. For example, a rotary powder agitator 225 could be used having spiral fluted sections (FIG. 13) circumscribing the outer periphery. A rotary powder agitator 325 (FIG. 15) could also be used having agitator paddles extending radially outward having a square cross-section.

Figure 6:
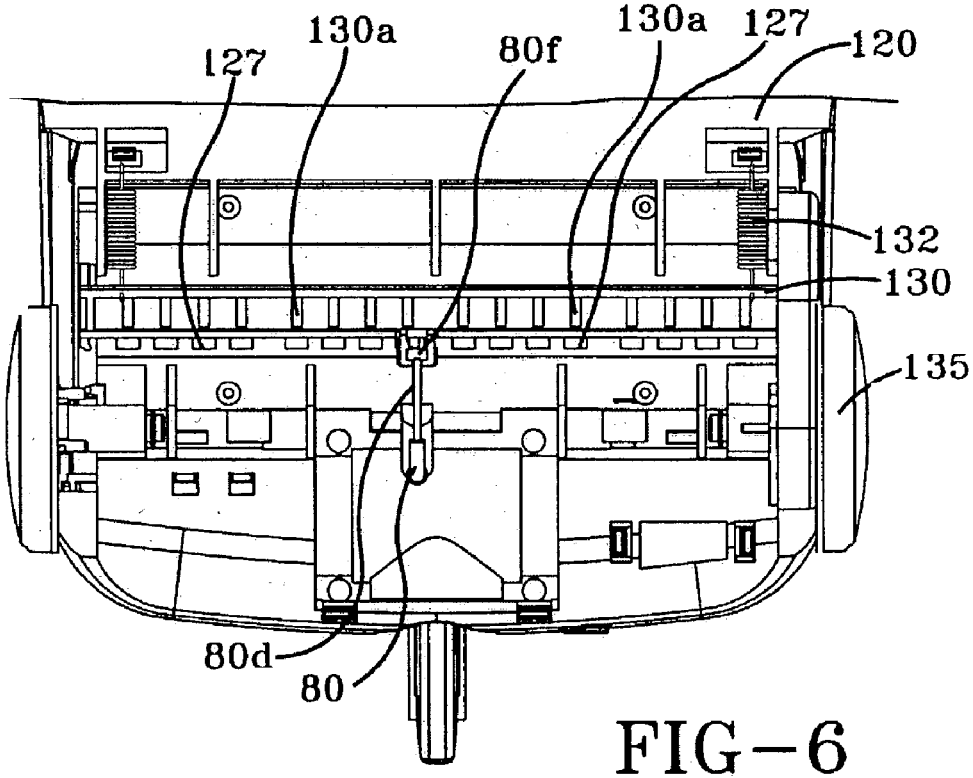
FIG. 6 is a bottom view of a cutaway portion of the foot for a dry powder carpet cleaner such as the one shown in FIG. 1 with the metering gate in the open position, according to the preferred embodiment of the present invention.
Figure 7:
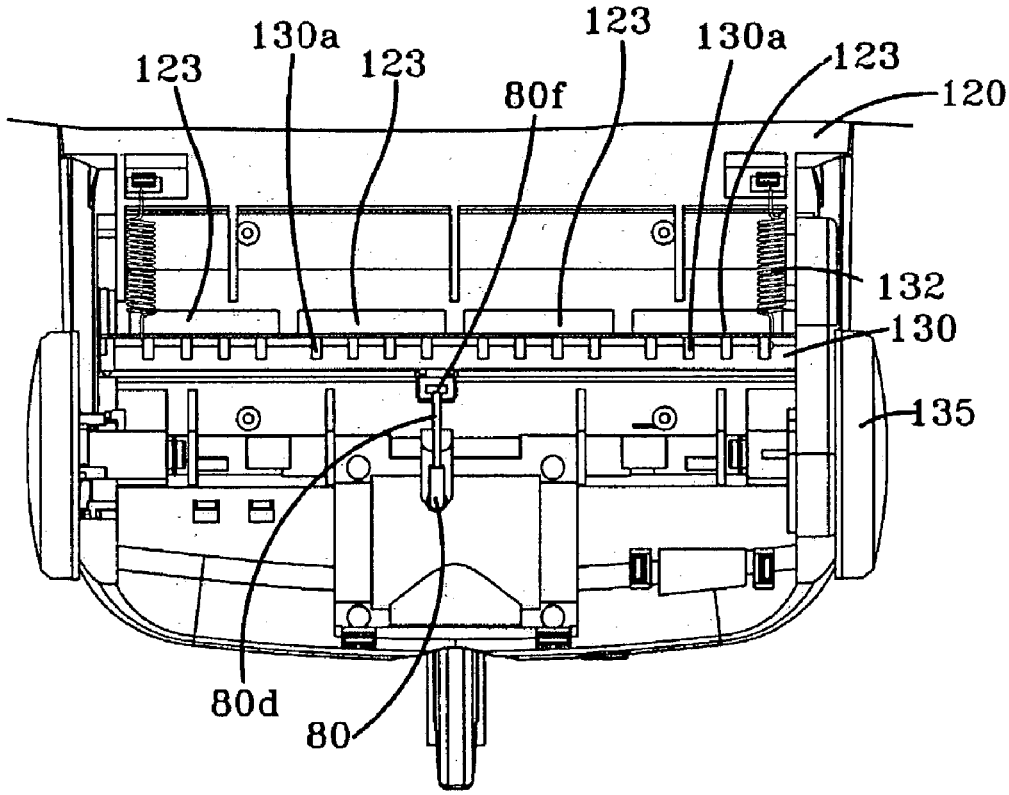
FIG. 7 is a bottom view of a cutaway portion of the foot for a dry powder carpet cleaner such as the one shown in FIG. 1 with the metering gate in the closed position, according to the preferred embodiment of the present invention.

Referring now to FIGS. 6 and 7, more detail of the operation of cable 80 on metering gate 130 is shown. FIG. 6 shows metering gate 130 in the closed position which prevents the dry powder in hopper 122 from falling through distribution slots 123. Metering gate 130 is biased into the closed position by springs 132. The lower end 80*d* of cable 80 is operably connected to metering gate 130 by a pin 80*f* fitted into a recess on metering gate 130. Cable 80 is a typical cable having an outer sheath 80*a* and an inner wire 80*g*. FIG. 7 shows metering gate 130 in the open position thereby exposing distribution slots 123 so that the dry powder cleaner can fall to the carpet surface from hopper 122. A plurality of projections 130 on the upper surface of metering gate 130 directly beneath each of the distribution slots 123 move into the distributions slots 123 as metering gate 130 is moved into the closed position to dislodge any dry powder cleaner that may have clumped in the distribution slot 123. A plurality of complementary recesses 127 on the lower surface of main body 120 receive the plurality of projections 130 as metering gate 130 is moved into the open position. The plurality of projections 130*a* on the upper surface of metering gate 130 are best seen in FIG. 2. When the plurality of projections 127 are formed on metering gate 130 a complementary recess is formed on the underside of metering gate 130 which are seen in FIGS. 6 and 7.

Figure 8:
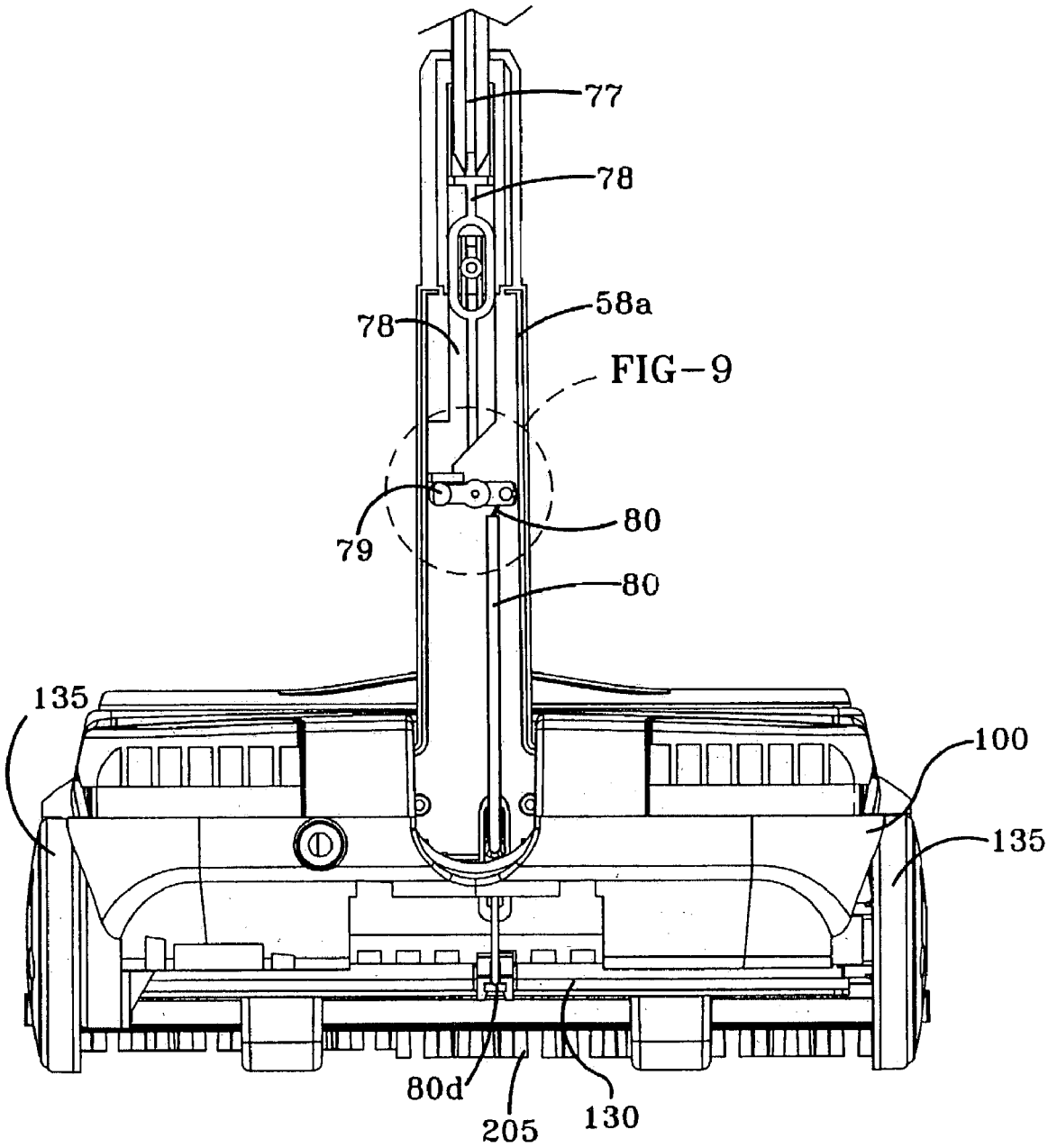
FIG. 8 is a rear view of a the foot for a dry powder carpet cleaner such as the one shown in FIG. 1 and a cutaway portion of the handle attached to the foot, according to the preferred embodiment of the present invention.
Figure 9:
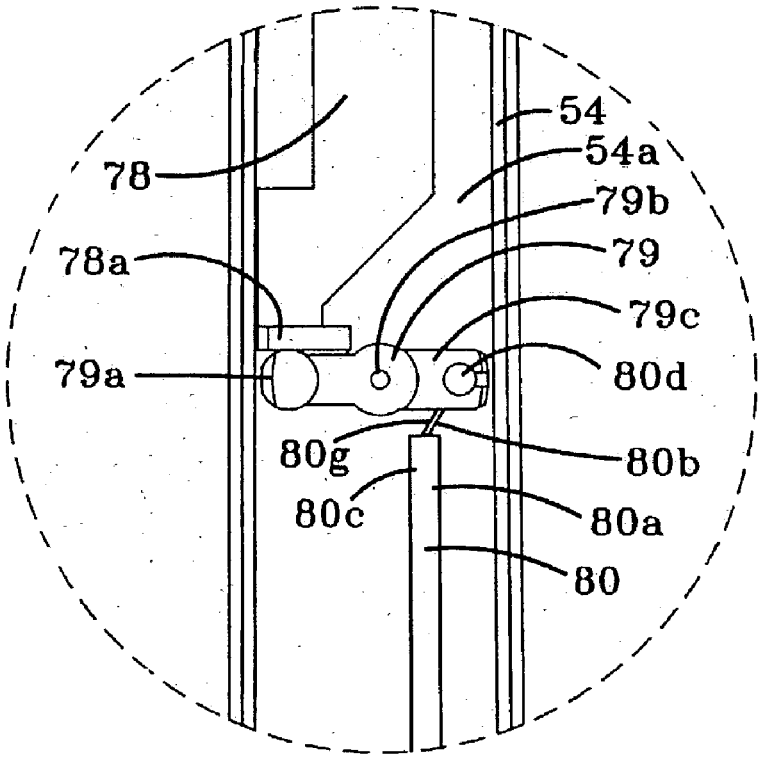
FIG. 9 is an enlarged view of a portion of the cutaway portion of the handle seen in FIG. 13 for a floor care cleaner such as the one shown in FIG. 1 with the actuator rod, lever, and cable in the normal position, according to the preferred embodiment of the present invention.
Figure 10:
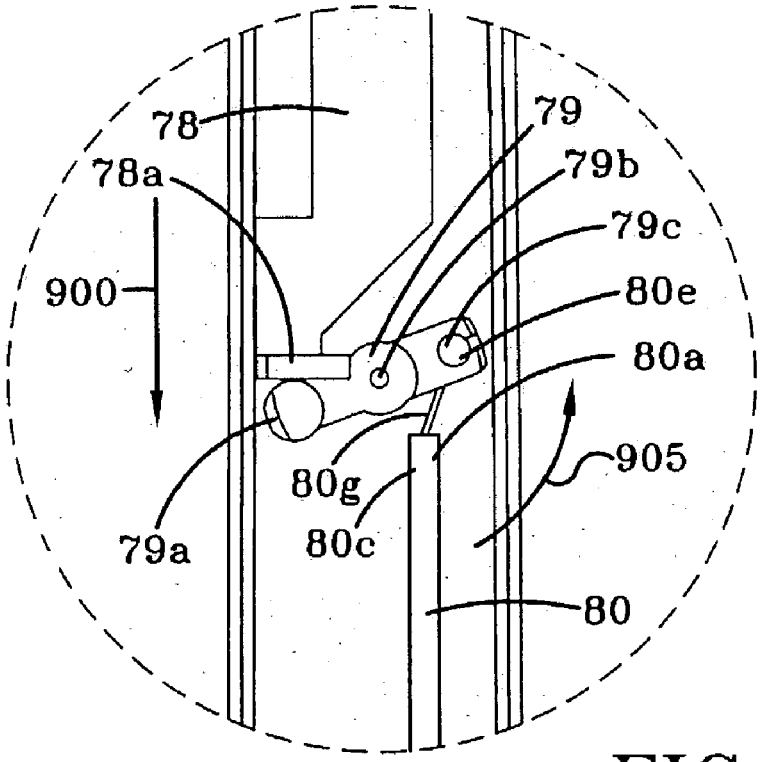
FIG. 10 is an enlarged view of a portion of the cutaway portion of the handle seen in FIG. 13 for a floor care cleaner such as the one shown in FIG. 1 with the actuator rod, lever, and cable in the release position, according to the preferred embodiment of the present invention.

Referring now to FIGS. 8 to 10, and partially to FIG. 2, the operation of trigger 75, rod sections 76,77 and 78, lever 79, and cable 80 on metering gate 130 is shown. When trigger 75 is depressed, a downward force is created and transmitted in the direction of arrow 900 through rod sections 76,77 and 78 to lever 79. A flat section 79*a* on the end of rod section 79 depresses a rounded end 79*a* of lever 79 causing the opposite or recessed end 79*c* to pivot upward in the direction of arrow 905. Lever 79 is pivotally attached at pivot 79*b* to the interior of lower handle section 54 of handle 50. The recessed end 79*c* of lever 79 is pivotally connected to the upper end 80*c* of cable 80 by a pin 80*d* fitted into a recess. Lever 79 changes the direction of force transmitted from trigger 75 in the opposite direction of arrow 900 thereby pulling on cable 80. Cable 80 in turns operates on metering gate 130 to expose distribution slots 123. When trigger 75 is released, all force is removed from rod sections 76,77 and 78 as well as cable 80 and metering gate 130 is forced into the closed position by springs 123.

Figure 11:
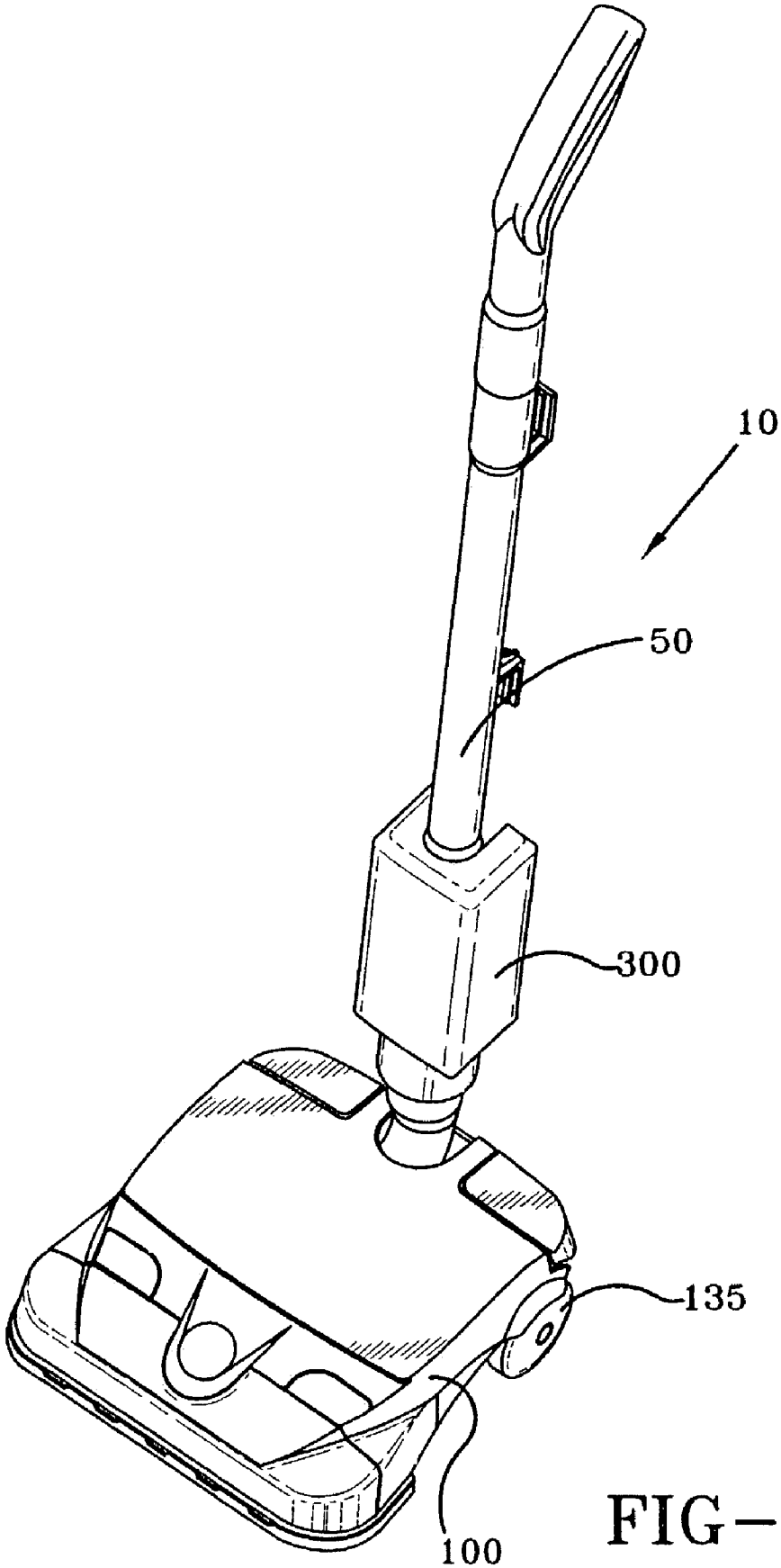
FIG. 11 is a front perspective view of a dry powder carpet cleaner, according to an alternate embodiment of the present invention.
Figure 12:
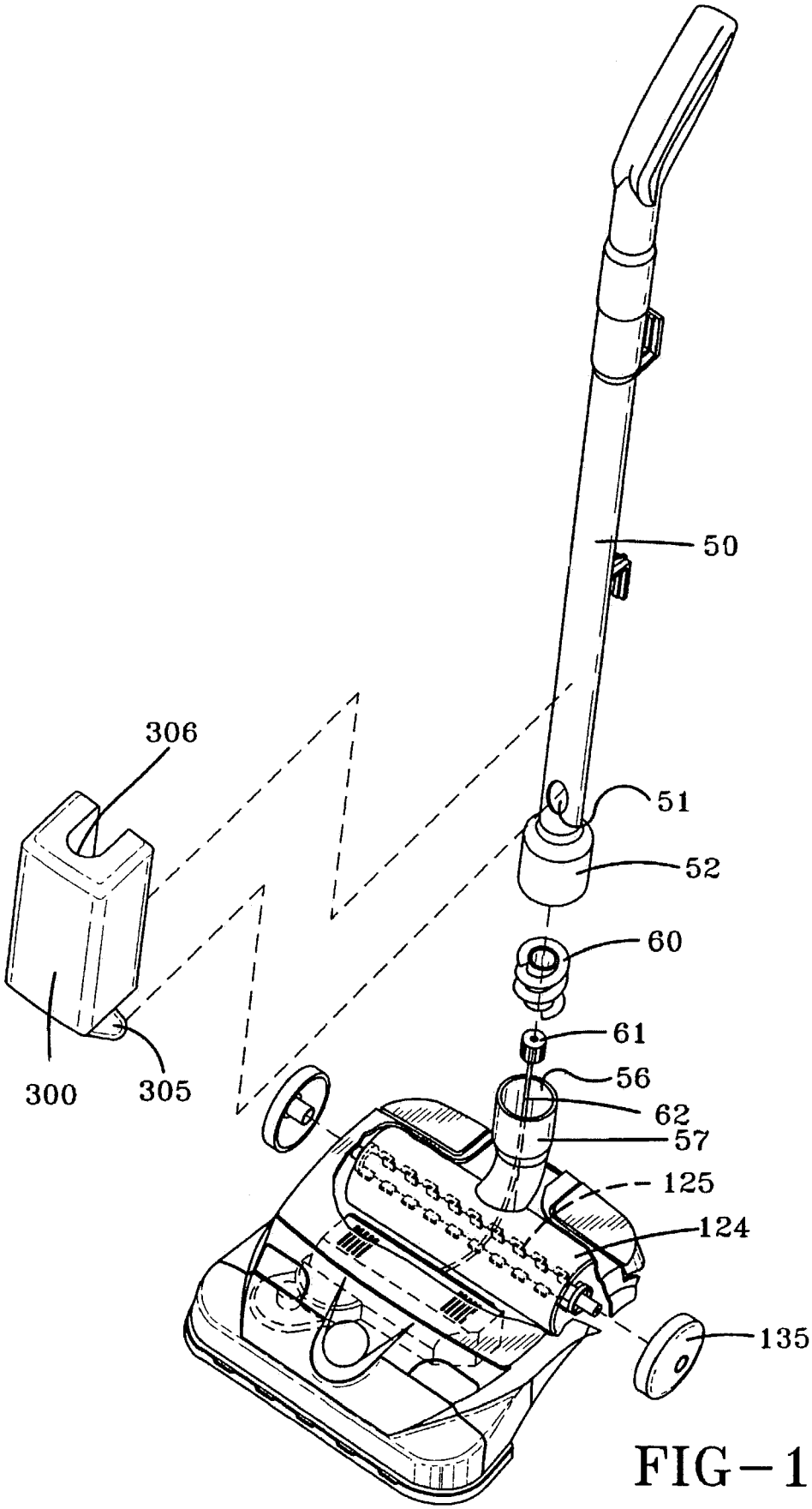
FIG. 12 is an exploded front perspective view of a dry powder carpet cleaner, according to an alternate embodiment of the present invention.
Figure 12A:
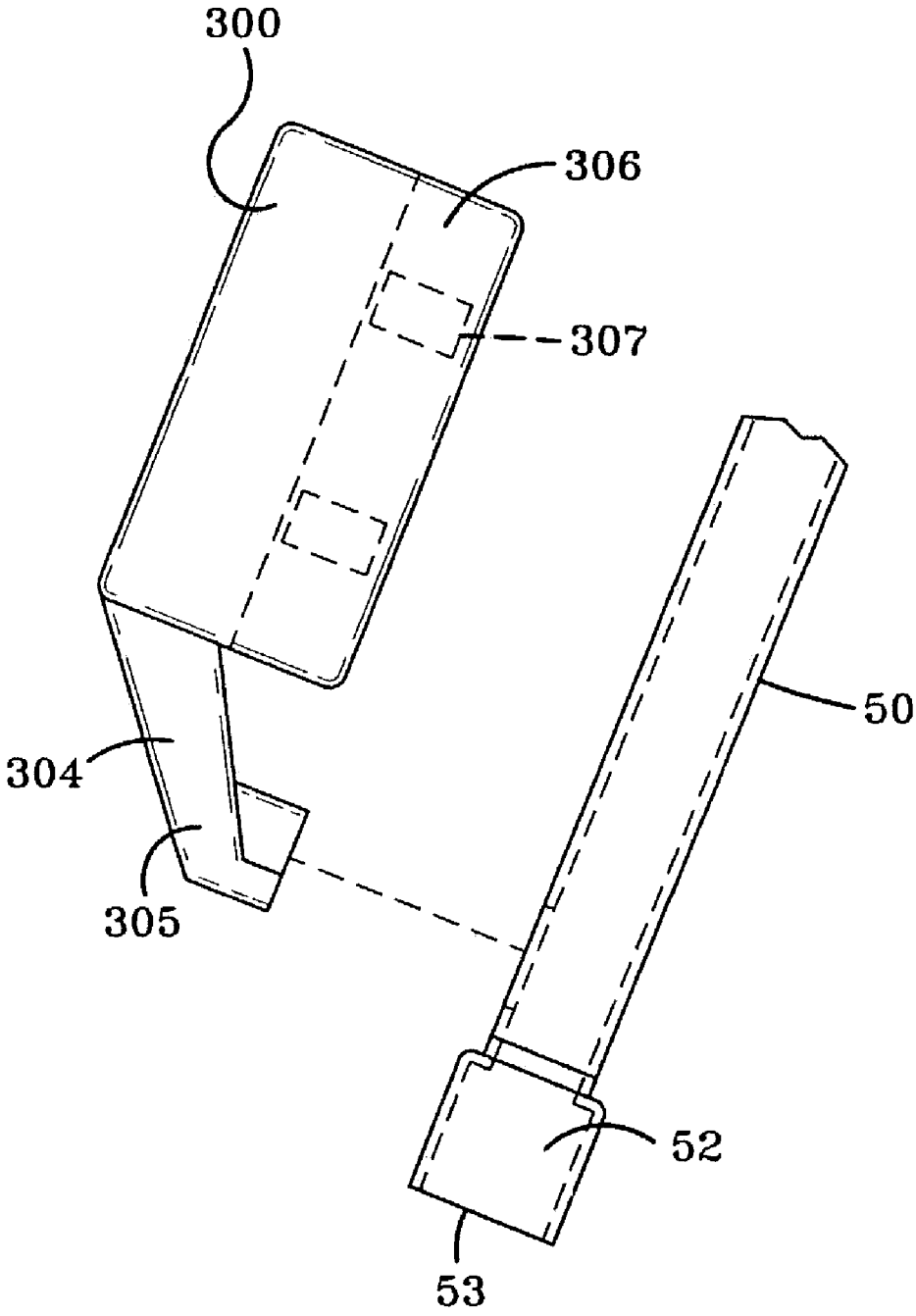
FIG. 12*a* is an exploded side front perspective view of a portion of the handle of the dry powder carpet cleaner of FIG. 6 and a dry powder cleaner dispensing bottle, according to an alternate embodiment of the present invention.

In another alternate embodiment of the invention, shown in FIGS. 11-12*a*, the hopper is replaced with a bottle 300 on the cleaner handle 50 containing the dry powder carpet cleaning composition. The neck 305 of the bottle 300 is received by an aperture 51 in handle 51 which acts as conduit to direct the dry powder cleaner to a chamber 124 from which the dry powder is distributed. The hollow interior of handle 50 acting as the conduit may contain a rotary auger 61 to prevent the dry powder cleaner from clumping within handle 50 and to feed the dry powder cleaner to the distribution chamber 124. The rotary auger 60 may be powered by a gear 61 powered by a rotary flexible shaft 62 powered by motor 210. Handle 50 has a socket portion 52 on the lower end for receiving a pivoting conduit 57 attached to foot 100. A rotary powder agitator 125 is also located in chamber 124 like in the preferred embodiment. The alternate embodiment could also include a trigger 55 arrangement with a multiple rod sections, a lever, and a cable to control a metering gate (not shown) for dispensing the dry powder cleaner like in the preferred embodiment. The bottle 300 attaches to handle 50 by a recessed portion 306 clamping onto handle 50 with at least two clamps 307 in a semi-interference type fit.

In an alternate embodiment of the invention (not shown), the dry powder is distributed by a broadcast type spreader. When the release trigger is pulled on the cleaner handle, dry powder is dispensed onto a rotating wheel beneath the main body. Radially extending guide vanes on the wheel propel the dry powder in an outwardly radial direction onto the carpet. After waiting a pre-determined period of time, the dry powder and absorbed dirt are vacuumed with a regular vacuum cleaner.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A carpet cleaning appliance of the type utilizing a granular chemical carpet cleaning composition, comprising:

a base;

a recess in the base for holding a quantity of a dry powder chemical carpet cleaning composition;

a plurality of distribution slots in the recess for distributing the dry powder chemical carpet cleaning composition onto the carpet;

a plurality of vertical axis rotary agitators for working the dry powder chemical carpet cleaning composition onto the carpet;

a handle operatively connected to said base for propelling said base over a carpet to be cleaned, said handle having a hollow interior acting as a conduit and in fluid communication with said recess;

an aperture in said handle;

a container filled with granular chemical carpet cleaning composition removably attached to said handle; and a spout protruding from said container for insertion into said aperture in said handle for fluidly connecting said container with said hollow interior of said handle, wherein said granular chemical carpet cleaning composition is free to flow from said container through said hollow interior of said handle into said recess.

2. The carpet cleaning appliance of claim 1, further comprising a metering gate located beneath said plurality of distribution slots for controlling the distribution of dry powder chemical carpet cleaning composition onto the carpet.

3. The carpet cleaning appliance of claim 2, further comprising a trigger for selectively controlling said metering gate.

4. The carpet cleaning appliance of claim 3, further comprising a linkage for operatively connecting said trigger to said metering gate.

5. The carpet cleaning appliance of claim 4, wherein said linkage is a member of the group consisting of a cable, rod, and a combination of one or more rods and a cable.

6. The carpet cleaning appliance of claim 1, wherein a powder mixing screw is located in the recess to mix the granular carpet cleaning composition and distribute the granular chemical carpet cleaning composition to said plurality of distribution slots.

7. The carpet cleaning appliance of claim 6, wherein said powder mixing screw is rotated by one or more of wheels that support said base as it is rolled over the carpet.

8. The carpet cleaning appliance of claim 6, wherein said powder mixing screw is rotated by rotary power from an electric motor.

9. The carpet cleaning appliance of claim 6, wherein said powder mixing screw has one or more radially extending agitator elements for mixing the dry powder chemical carpet cleaning composition.

10. The carpet cleaning appliance of claim 9, wherein said one or more agitator elements are square shaped.

11. The carpet cleaning appliance of claim 9, wherein said one or more agitator elements are rectangular shaped.

12. The carpet cleaning appliance of claim 9, wherein said one or more agitator elements are flexible squeegee elements.

13. The carpet cleaning appliance of claim 6, wherein said powder mixing screw has one or more fluted shaped radially extending agitator elements for mixing the dry powder chemical carpet cleaning composition in the hopper.

14. The carpet cleaning appliance of claim 1, wherein said container has an integrally formed recess in the elongated direction for receiving said handle and at least one clamp for removably holding said container to said handle.

15. The carpet cleaning appliance of claim 1, further comprising an auger located in the hollow interior of said handle between said aperture and said recess for mixing said granular the dry powder chemical carpet cleaning composition and aiding the flow of the dry powder chemical carpet cleaning composition through said hollow interior of said handle.

16. A carpet cleaning appliance, comprising:

a base;

a handle extending upwardly from the base;

a chamber in the base for holding a quantity of a dry powder chemical carpet cleaning composition;

a plurality of distribution slots for distributing the dry powder chemical carpet cleaning composition onto the carpet;

a plurality of vertical axis rotary agitators for working the dry powder chemical carpet cleaning composition onto the carpet; and a container located remotely from said chamber and said plurality of distribution slots, said container retaining a supply of the dry powder chemical carpet cleaning composition and feeding the dry powder chemical carpet cleaning composition to said chamber, wherein said container feeds the dry powder carpet cleaning composition into said handle through an aperture in said handle, said handle being hollow and acting as a conduit to direct said dry powder carpet cleaning composition into said chamber.

17. The carpet cleaning appliance of claim 16, wherein said container is removably attached to said handle.

18. The carpet cleaning appliance of claim 16, further including a rotary auger in said handle for mixing the dry powder carpet cleaning composition as the dry powder carpet cleaning composition is fed from said container to said chamber.

* * * * *